US006171088B1

(12) United States Patent
Sun et al.

(10) Patent No.: US 6,171,088 B1
(45) Date of Patent: Jan. 9, 2001

(54) SCROLL COMPRESSOR WITH SLANTED BACK PRESSURE SEAL

(75) Inventors: Zili Sun; Thomas R. Barito, both of Arkadelphia, AR (US)

(73) Assignee: Scroll Technologies, Arkadelphia, AR (US)

( * ) Notice: Under 35 U.S.C. 154(b), the term of this patent shall be extended for 0 days.

(21) Appl. No.: 09/417,935

(22) Filed: Oct. 13, 1999

(51) Int. Cl.[7] ..... F04C 18/00
(52) U.S. Cl. ..... 418/55.4; 418/55.4; 418/57
(58) Field of Search ..... 418/55.4, 55.5, 418/57

(56) References Cited

U.S. PATENT DOCUMENTS 4,992,032 * 2/1991 Barito et al. ..... 418/55.5
4,993,928 * 2/1991 Fraser, Jr. ..... 418/55.5
5,040,956 * 8/1991 Barito et al. ..... 418/55.5
5,145,345 * 9/1992 Barito et al. ..... 418/55.4
5,447,418 * 9/1995 Takeda et al. ..... 418/55.4
5,857,844 * 1/1999 Lifson et al. ..... 418/55.5
5,989,000 * 11/1999 Tomayko et al. ..... 418/55.5
6,077,057 * 6/2000 Hugenroth et al. ..... 418/55.5

FOREIGN PATENT DOCUMENTS 63-106388 * 5/1988 (JP) ..... 418/55.5
1-177483 * 7/1989 (JP) ..... 418/55.5

* cited by examiner

*Primary Examiner*—Thomas Denion
*Assistant Examiner*—Theresa Trieu
(74) *Attorney, Agent, or Firm*—Carlson, Gaskey & Olds

(57) ABSTRACT

An improved seal for use in scroll compressors incorporates a slanted coil spring. In the prior art, generally C-shaped leaf springs have been utilized. The slanted coil spring has better survivability against operational extremes than the prior art.

2 Claims, 2 Drawing Sheets

SCROLL COMPRESSOR WITH SLANTED BACK PRESSURE SEAL

BACKGROUND OF THE INVENTION

This invention relates to an improved seal design for use in defining the back pressure chamber in a scroll compressor.

Scroll compressors are becoming increasingly popular in refrigerant compression applications. In a scroll compressor, a first scroll member has a base and a generally spiral wrap extending from the base. A second scroll member is driven to orbit relative to the first scroll member and has a base and a generally spiral wrap interfitting with the spiral wrap of the first scroll member. The wraps interfit to define compression chambers. As the second scroll member orbits relative to the first, the size of the compression chambers is reduced, and an entrapped refrigerant is compressed.

There are many challenges for the scroll compressor designer. In one main challenge, the compressed refrigerant creates a force, tending to separate the two scroll members away from each other. The sealing of the compression chambers is achieved by having the wraps in contact with the base of the opposed scroll member. As the two scroll members are forced away from each other by this "separating" force, this sealing contact might be lost, and the efficiency of the compressor could drop.

To combat this separating force, scroll compressor designers have tapped a portion of the entrapped refrigerant to a chamber behind one of the two scroll member bases. The entrapped refrigerant creates a force tending to hold the two scroll members together. This so-called "back chamber" is utilized in most modem scroll compressors. One known "back chamber" is defined outwardly of the base of the second scroll member. An inner seal and an outer seal define a chamber between the base of the second scroll member and a forward face of a crankcase which supports the second scroll member. These seals have typically been generally C-shaped with an internal C-shaped leaf spring biasing the outer ends of the seal into contact with the base of the second scroll member, and with a base of a groove which receives the seal. The seals are effective in defining the back pressure chamber, and sealing against leakage.

However, during certain operational conditions, the forces on the seals are not as expected. In particular, as an example, during reverse rotation the pressure forces in the compressor change rapidly and dramatically. In some cases, the lips of the C-shaped seal can be forced together. With the prior art C-shaped seals with an internal C-shaped leaf spring, the springs have sometimes been damaged when forced together.

So called APS seals are known which have a slanted internal coil spring. However, this type spring has not been used to define a back pressure chamber behind the orbiting scroll base plate. It would be desirable to design a seal which has a better survivability during such occurrences.

SUMMARY OF THE INVENTION

In a disclosed embodiment of this invention, a seal for a scroll compressor back pressure chamber is generally C-shaped and has an inner and outer lip. A coil spring is captured between the lips. The coils are slanted relative to a circumferential direction of the scroll compressor. That is, the coils are slanted such that they do not define planes which are parallel to a central circumferential axis of the coil spring. Of course, this would be true of any coil spring due to the helix angle. However, in the inventive coil springs, it is preferred that the slant angle be less than 80° when measured from the central axis. While coil springs may have been suggested for use in scroll compressors back pressure chambers in the past, the coil springs have typically been standard coil springs which have coils which are not slanted, and which would have an angle approaching 90°.

The present invention utilizing the slanted coil springs, develops a seal which is better able to withstand the crushing force during non-standard operation, such as reverse rotation.

In a preferred embodiment, ends of the seal have their coils interfitted to secure the spring together.

These and other features of the present invention can be best understood from the following specification and drawings, the following of which is a brief description.

DETAILED DESCRIPTION OF A PREFERRED EMBODIMENT

Figure 1:
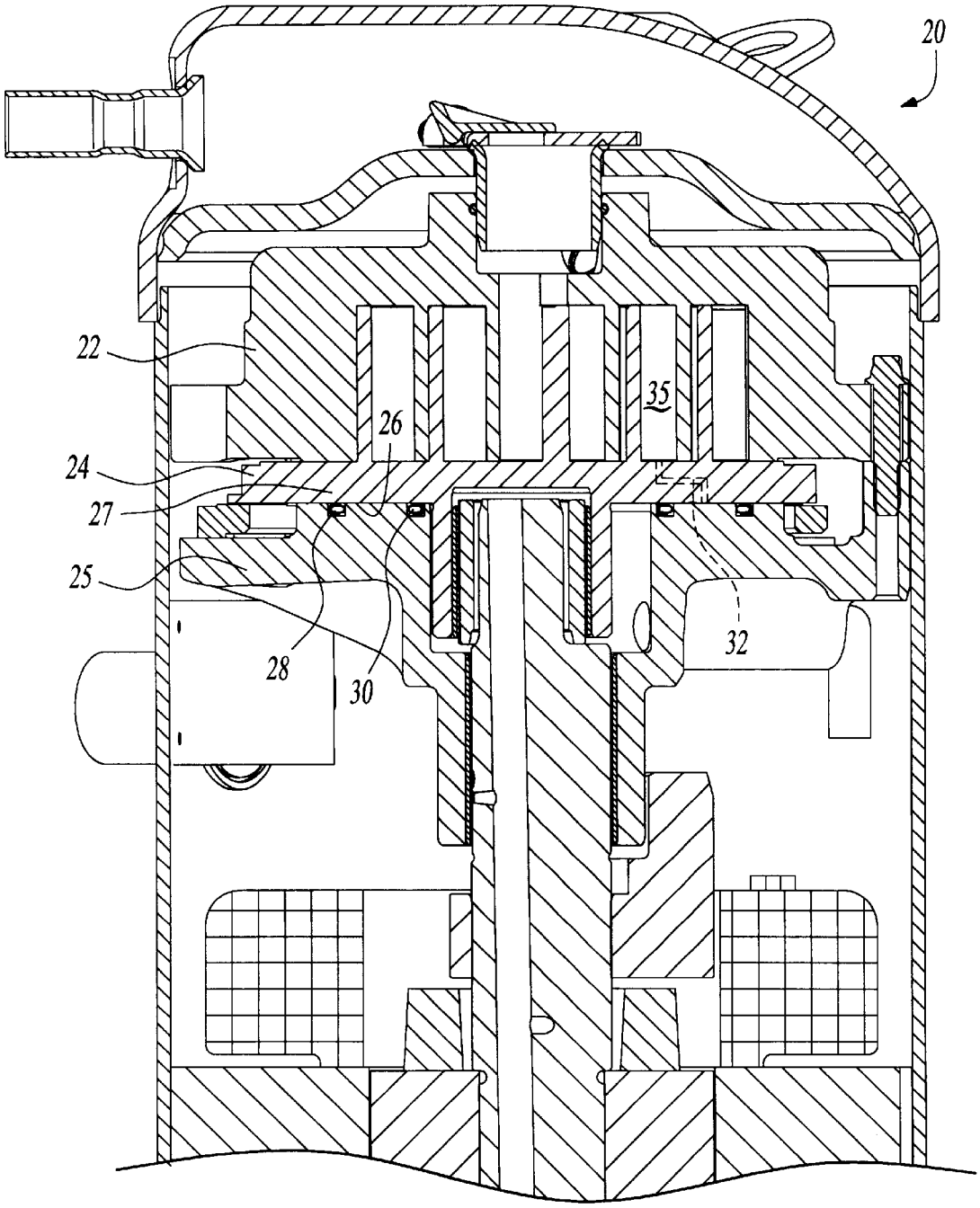
FIG. 1 shows a scroll compressor.

FIG. 1 shows a scroll compressor 20 incorporating a non-orbiting or fixed scroll 22 having a wrap interfitting with the wrap of an orbiting scroll 24. A back pressure chamber 26 is defined between a rear face of a base 27 of the orbiting scroll 24, and a forward face of a crankcase 25. An outer seal 28 and an inner seal 30 seal the back pressure chamber. A tap 32 communicates with a compression chamber 33 between the wraps of the orbiting and non-orbiting scrolls 22 and 24, and taps an entrapped refrigerant to the back pressure chamber 26. The description to this point is largely in keeping with the prior art and traditional scroll compressor design.

Figure 2:
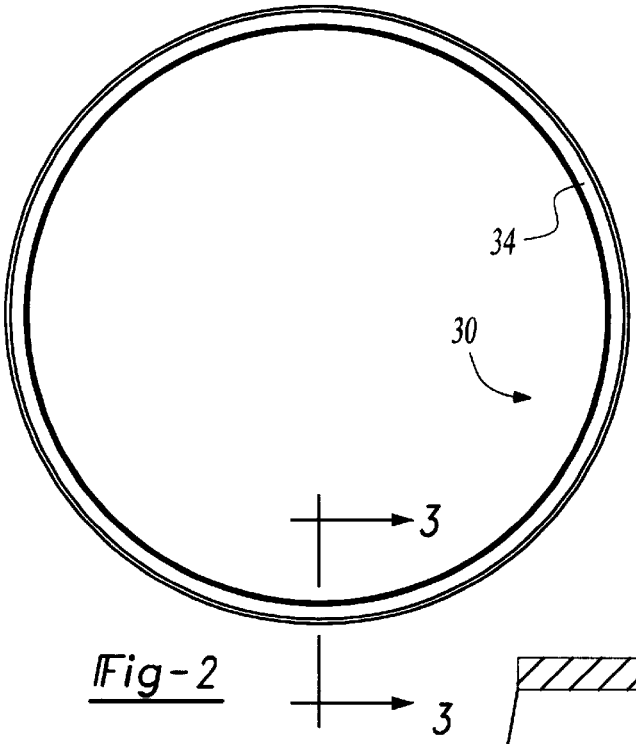
FIG. 2 is a view of a seal utilizing in the back pressure chamber of a scroll compressor.

FIG. 2 shows the seal 30 as is shown in FIG. 1. Seal 28 would have a similar structure. As shown, seal 30 incorporates a resilient seal member 34.

Figure 3:
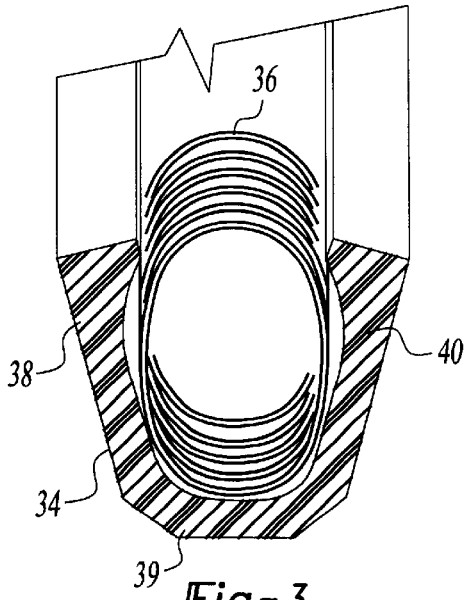
FIG. 3 is a cross sectional view generally along the line 3—3.

As can be appreciated from FIG. 3, the resilient body 34 captures an internal coil spring 36 between a pair of opposed lips 38 and 40. A back wall 39 connects the lips 38 and 40.

Figure 4B:
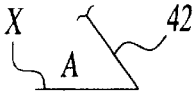
FIG. 4*b* geometrically shows one feature of a spring incorporated into the inventive seal.
Figure 4A:
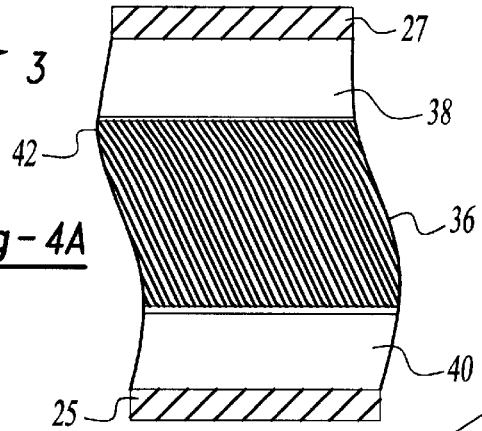
FIG. 4*a* is a view looking into the seal.

As can be appreciated from FIG. 4*a*, the coil spring 36 biases the lip 38 upwardly into contact with the base 27 of the orbiting scroll 24, and also biases lip 40 into contact with a portion of the crankcase 25. The coils in the coil spring 36 are shown to be slanted relative to a central circumferential axis of the coil spring.

As shown in FIG. 4*b*, a plane 42 of one of the coils could be seen as being at an angle A relative to the central axis X. All coil springs have their coils at some angle, due to the helix angle of the coil. However, in a standard coil spring, this angle is approximately 90°, such that any one coil looks to be approximately perpendicular to the axis X.

In the instant invention, the angle is chosen to be less than 80°. In such cases, the coil spring is slanted at an angle, which is less than 80° relative to the axis X. This basic seal structure is known, it is the application in the rear of an orbiting scroll base plate which is inventive.

The present invention is better able to withstand a crushing force during extreme operational conditions. Due to the slanted coils, the coils will "bounce back" to the relaxed position more easily when the lips 38 and 40 are crushed together.

Figure 5:
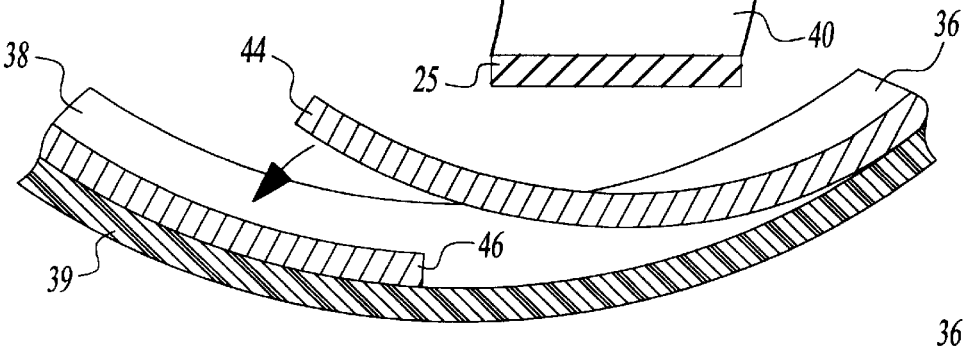
FIG. 5 shows an assembly detail of the inventive seal.
Figure 6:
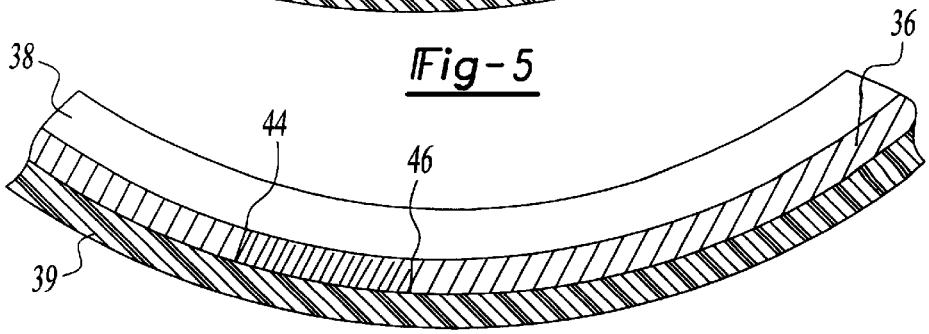
FIG. 6 shows the step after the FIG. 5 assembly step.

FIG. 5 shows a view wherein the extreme ends 44 and 46 of the spring 36 are being brought together. In FIG. 6, the end coils 44 and 46 have been interlaced to secure the spring. Preferably, no rigid connection such as a weld is utilized between the ends 44 and 46.

The present invention is directed to the use of a slanted coil spring in a particular location. The resulting seal has better survivability against operational extreme conditions.

Although a preferred embodiment of this invention has been disclosed, a worker in this art would recognize that certain modifications would come within the scope of this invention. For that reason the following claims should be studied to determine the true scope and content of this invention.

What is claimed is:

1. A scroll compressor comprising:

a first scroll member having a base and a generally spiral wrap extending from said base;

a second scroll member having a base and a generally spiral wrap extending from said base, said scroll wraps from said first and second scroll members interfitting to define compression chambers;

a crankcase supporting said second scroll member, said crankcase having a forward face supporting a rear face of said base of said second scroll member;

a back pressure chamber defined between said forward face of said crankcase and said rear face of said base of said second scroll member, there being inner and outer seals defining said back pressure chamber; and said seals each including a generally C-shaped sealing member and an entrapped coil spring, said coil spring being provided by a plurality of coils each extending at an angle such that a plane of said coil generally intersects a central axis of said coil spring at an angle that is less than 80°.

2. A scroll compressor as recited in claim 1, wherein said seals are received in grooves in said crankcase.

* * * * *